US010001314B2

(12) United States Patent
Kim

(10) Patent No.: US 10,001,314 B2
(45) Date of Patent: Jun. 19, 2018

(54) FREEZER

(71) Applicant: SNOPA CO., LTD., Gyeonggi-do (KR)

(72) Inventor: Jeong Kap Kim, Gyeonggi-do (KR)

(73) Assignee: SNOPA CO., LTD., Anseong-si, Gyeonggi-do (KR)

( * ) Notice: Subject to any disclaimer, the term of this patent is extended or adjusted under 35 U.S.C. 154(b) by 152 days.

(21) Appl. No.: 14/913,377

(22) PCT Filed: Sep. 2, 2013

(86) PCT No.: PCT/KR2013/007876
§ 371 (c)(1),
(2) Date: Feb. 22, 2016

(87) PCT Pub. No.: WO2015/030285
PCT Pub. Date: Mar. 5, 2015

(65) Prior Publication Data

US 2016/0209098 A1 Jul. 21, 2016

(30) Foreign Application Priority Data

Aug. 27, 2013 (KR) ..... 10-2013-0101560

(51) Int. Cl.
*F25D 17/04* (2006.01)
*F25D 17/06* (2006.01)
(Continued)

(52) U.S. Cl.
CPC ..... *F25D 17/06* (2013.01); *F25D 11/00* (2013.01); *F25D 17/062* (2013.01); *F25D 21/08* (2013.01);
(Continued)

(58) Field of Classification Search
CPC ..... F25D 11/00; F25D 17/062; F25D 21/08; F25D 21/14; F25D 25/02; F25D 17/067;
(Continued)

(56) References Cited

U.S. PATENT DOCUMENTS 6,293,122 B1 * 9/2001 Chang ..... F25D 17/065 62/408
6,519,962 B1 2/2003 Schuetter
2003/0041615 A1 * 3/2003 Kim ..... F25D 17/065 62/407
2005/0076662 A1 * 4/2005 Roche ..... A47F 3/0447 62/246
2007/0289321 A1 * 12/2007 Kang ..... F25D 11/022 62/186
2009/0277210 A1 * 11/2009 Eveland ..... F25D 11/02 62/441
(Continued)

FOREIGN PATENT DOCUMENTS

JP 2001-241839 A 9/2001
KR 20-1996-0006154 Y1 7/1996
(Continued)

OTHER PUBLICATIONS

International Search Report for PCT/KR2013/007876 dated May 14, 2014 from Korean Intellectual Property Office.

*Primary Examiner* — Len Tran
*Assistant Examiner* — Kamran Tavakoldavani
(74) *Attorney, Agent, or Firm* — Revolution IP, PLLC

(57) ABSTRACT

A supercooling freezer including: a body having a cooling chamber having shelves on which objects to be accommodated are placed and a door for opening or closing the side surface of the cooling chamber; an evaporator disposed at the upper portion of the cooling chamber to cool the air of the cooling chamber; a cooling duct for accommodating the evaporator therein; air circulation fans disposed in front of the evaporator in the cooling duct to supply the air of the cooling chamber to the evaporator; a cool air supply duct connected with the cooling duct to induce the air cooled through the evaporator in the cooling duct to the bottom of the cooling chamber; and extension ducts projecting from the cool air supply duct in a direction in which the door is positioned to supply cool air to the objects above the objects placed on the shelves.

10 Claims, 5 Drawing Sheets

(51) Int. Cl.

| | |
|---|---|
| ***F25D 25/02*** | (2006.01) |
| ***F25D 11/00*** | (2006.01) |
| ***F25D 21/08*** | (2006.01) |
| ***F25D 21/14*** | (2006.01) |
| ***F25D 27/00*** | (2006.01) |

(52) U.S. Cl.
CPC ..... *F25D 21/14* (2013.01); *F25D 25/02* (2013.01); *F25D 25/028* (2013.01); *F25D 27/00* (2013.01)

(58) Field of Classification Search
CPC .... F25D 17/08; F25D 29/008; F25D 2317/06; F25D 2317/063; F25D 2317/0655; F25D 2317/0672
See application file for complete search history.

(56) References Cited

U.S. PATENT DOCUMENTS

| | | | | |
|---|---|---|---|---|
| 2010/0024446 | A1* | 2/2010 | Rohrer | A47F 3/0447 62/89 |
| 2013/0098075 | A1* | 4/2013 | Hegedus | F25D 21/08 62/80 |

FOREIGN PATENT DOCUMENTS

| | | | |
|---|---|---|---|
| KR | 20-1999-0017206 | U | 5/1999 |
| KR | 10-1205822 | B1 | 11/2012 |

* cited by examiner

[Fig. 1]
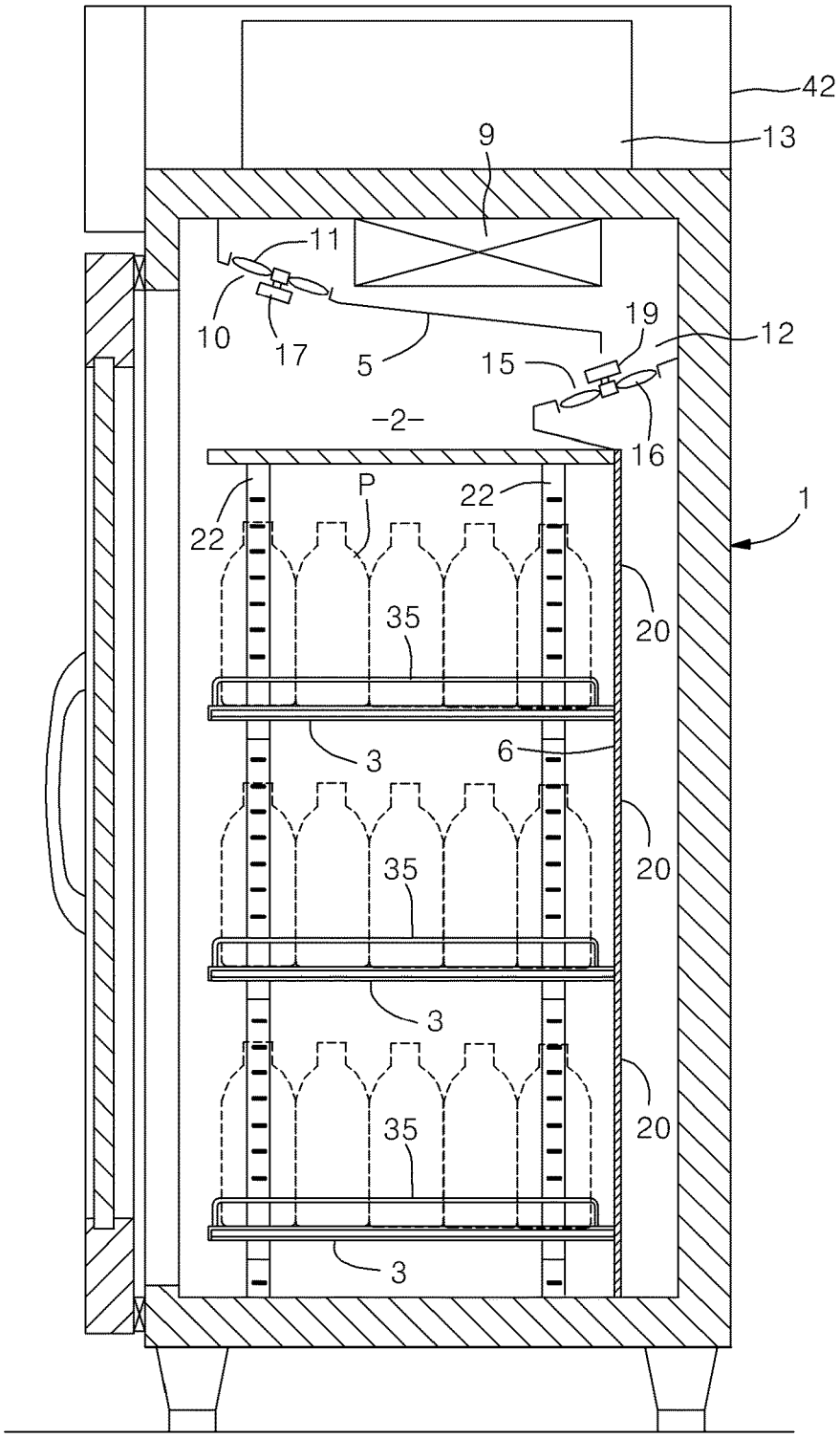

[Fig. 2]
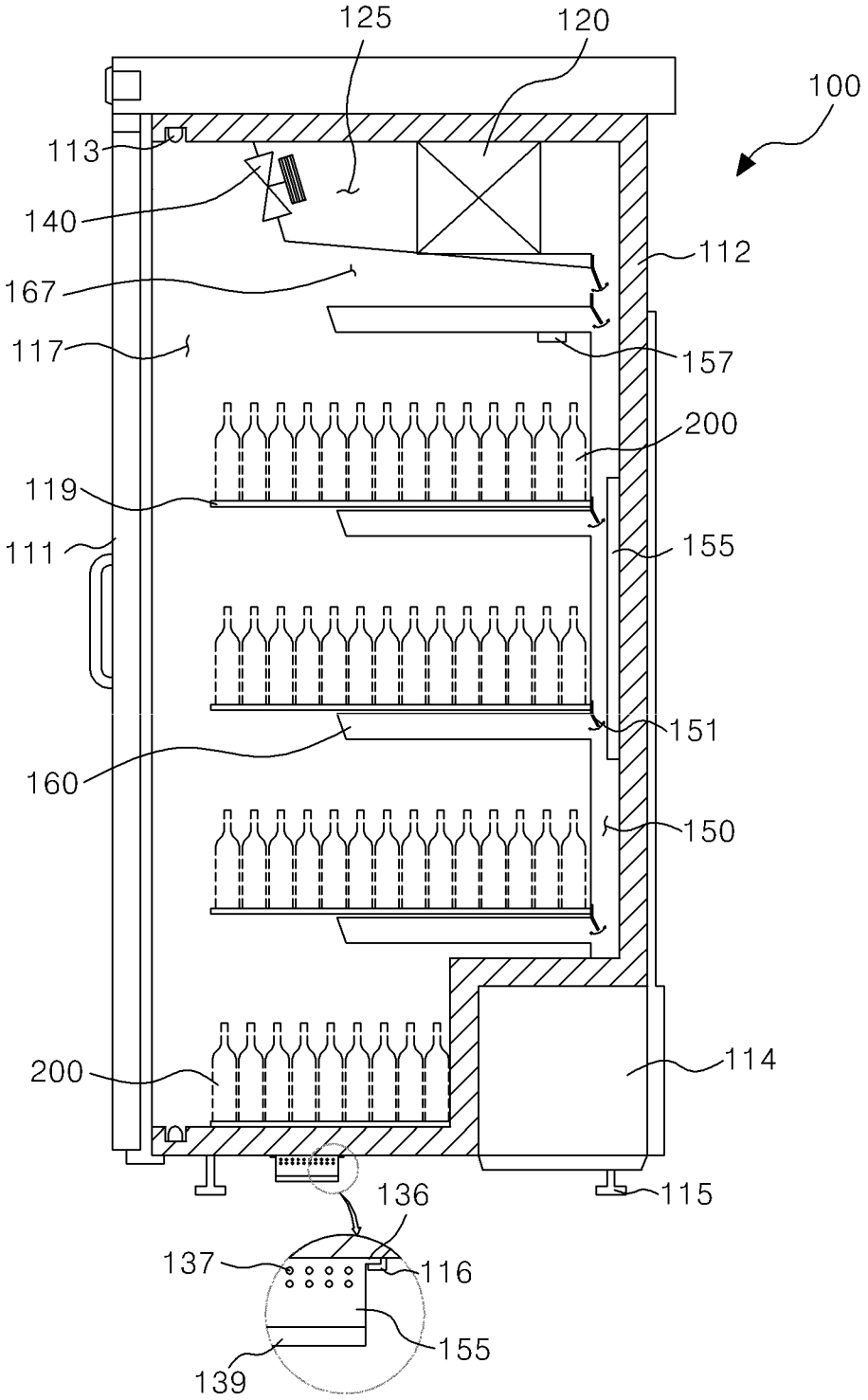

[Fig. 3]
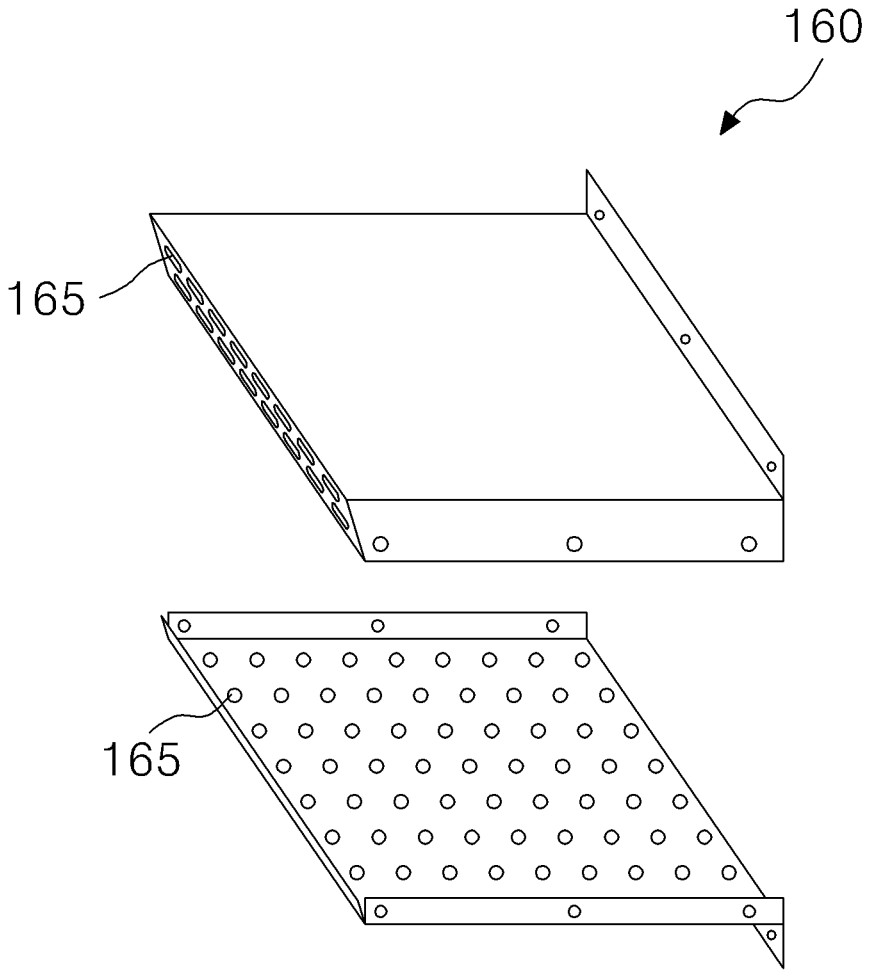

[Fig. 4]
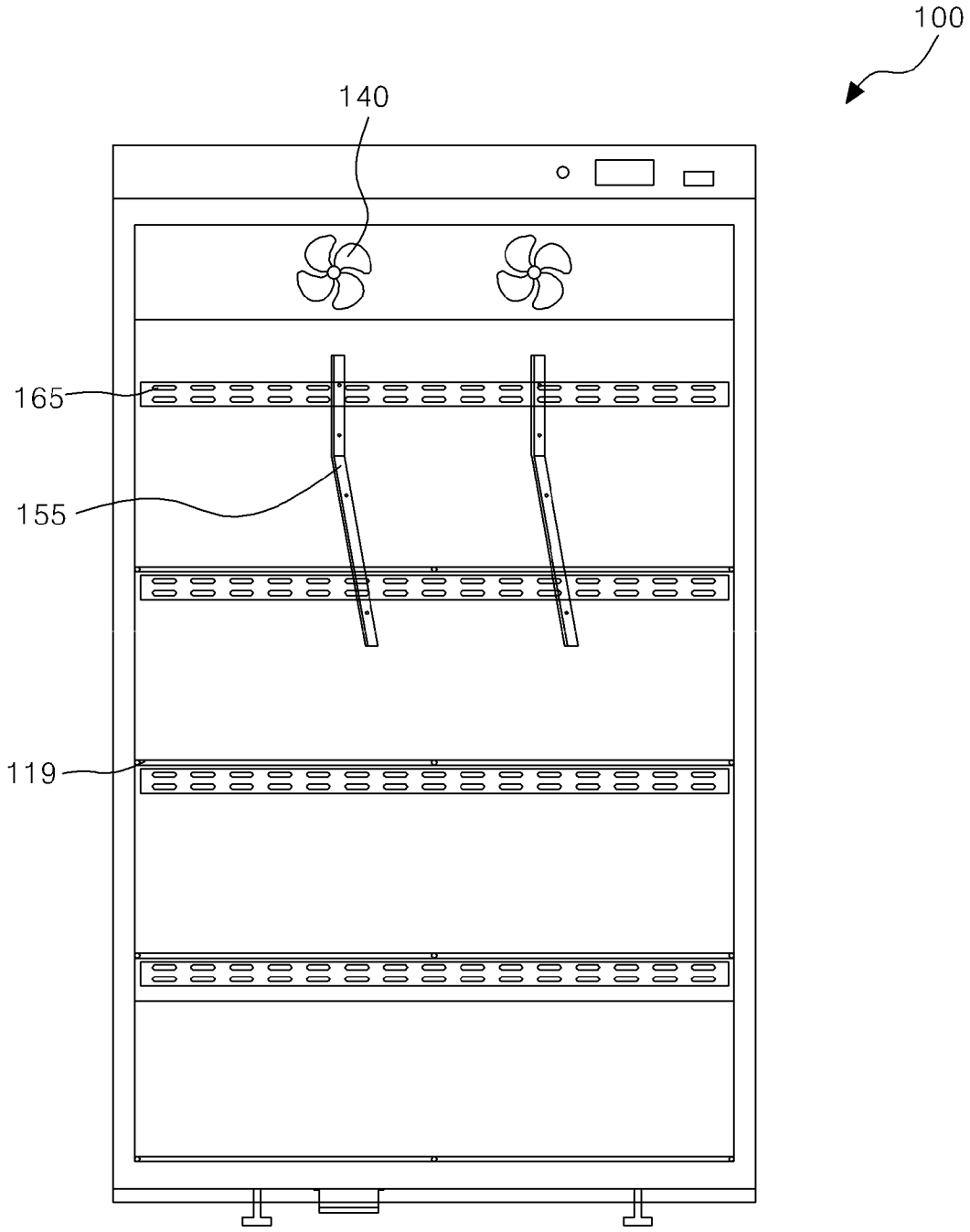

[Fig. 5]
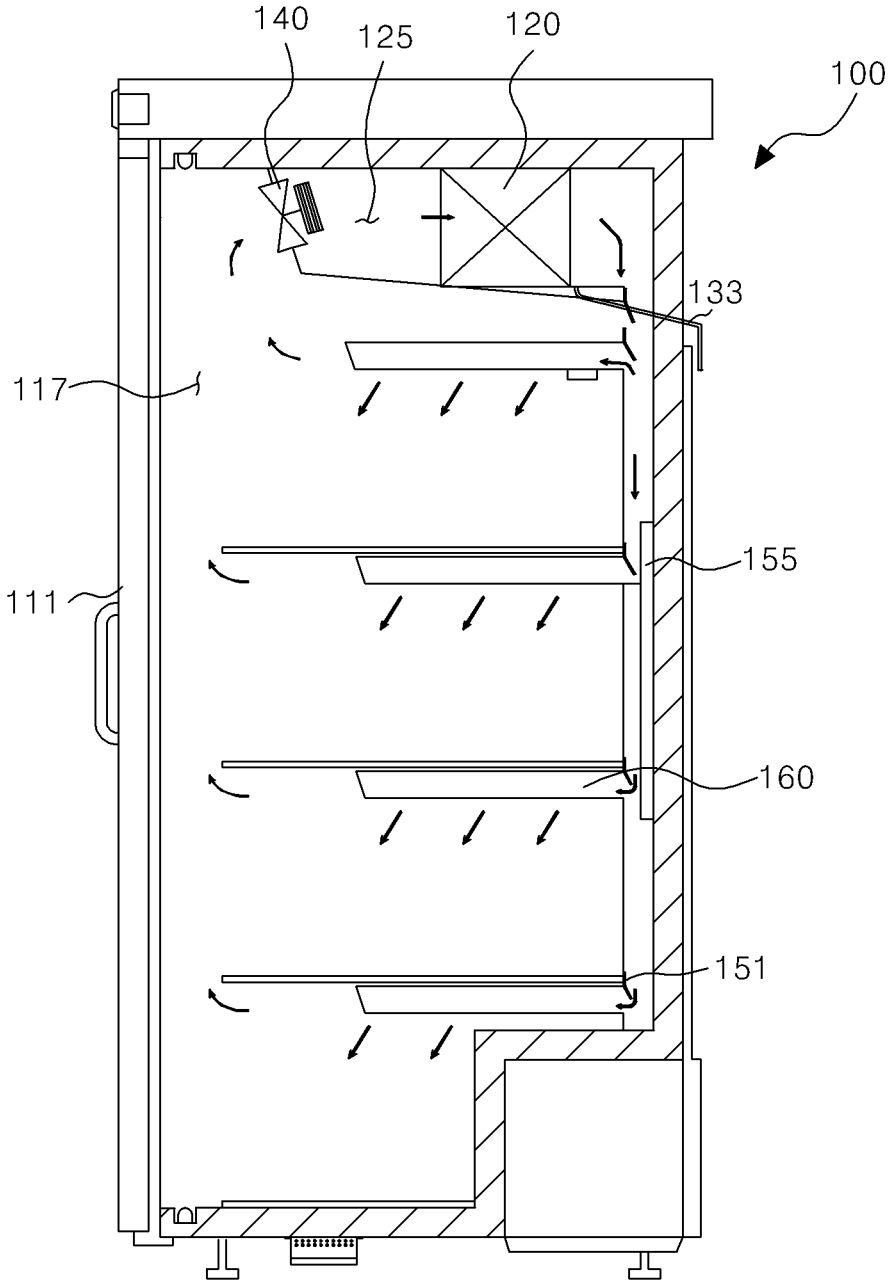

FREEZER

CROSS REFERENCE TO PRIOR APPLICATIONS

This application is a National Stage Application of PCT International Patent Application No. PCT/KR2013/007876 filed on Sep. 2, 2013, under 35 U.S.C. § 371, which claims priority to Korean Patent Application No. 10-2013-0101560 filed on Aug. 27, 2013, which are all hereby incorporated by reference in their entirety.

TECHNICAL FIELD

The present invention relates to a supercooling freezer for supercooling objects accommodated therein.

BACKGROUND ART

Supercooling is a phenomenon where even if a melt or solid is cooled below its phase transition temperature in its equilibrium state, it is not changed. Matters have their stable state according to their respective temperatures, and if the temperatures are slowly changed, the atoms of the matters can keep up with the changes of the temperature, while maintaining the stable states at their respective temperatures. However, if the temperatures are suddenly changed, the atoms of the matters cannot be changed gently to the stable states corresponding to the respective temperatures, so that the atoms of the matters are maintained still in the stable states at a starting temperature or a portion of the atoms of the matters is changed just to the state at a final temperature.

If a supercooled beverage is put in a cold cup or if impacts or vibrations are applied to the supercooled beverage, the beverage is not completely frozen or melt. That is, a slush type beverage can be provided to a consumer.

One of conventional supercooling freezers for providing supercooled beverages is disclosed in Korean Patent Registration No. 10-1205822 (issued on Nov. 22, 2012), which is illustrated in FIG. 1.

As shown in FIG. 1, the conventional supercooling freezer includes a cooling chamber 2 for accommodating liquid type beverages P therein, a heat exchanger 9 for cooling the air inside the cooling chamber 2, a cooling duct 5 for housing the heat exchanger 9 therein, an inlet 10 formed on a portion of the cooling duct 5, a cool air discharge hole 12 formed on a different position from the inlet 10 of the cooling duct 5, a cool air supply duct 6 for circulating the air inside the cooling chamber 2, an introduction hole 15 formed on one side of the cool air supply duct 6, ventilation holes 20 for blowing the air in the cool air supply duct 6 to the cooling chamber 6, and a fan 16 mounted to face the introduction hole 15 of the cool air supply duct 6. According to the conventional supercooling freezer, the cooling duct 5 absorbs the air in the cooling chamber 2 from the inlet 10 and cools the air through the heat exchanger 6. Next, the cool air is discharged through the cool air discharge hole 12. The cool air supply duct 6 is located in an up and down direction of the cooling chamber 2, and the introduction hole 15 is formed to face the cool air discharge hole 12 and at the same time to face the cooling chamber 2. Through the rotation of the fan 16, accordingly, the cool air is absorbed from the introduction hole 12 and transmitted to the cool air supply duct 6.

Under the above-mentioned configuration, the conventional supercooling freezer can supercool the beverages P accommodated in the cooling chamber 2, but the cooling duct 5 from which the cool air is supplied is located on the rear surface of the freezer. Further, the door of the freezer is frequently open and closed. Accordingly, the internal temperature of the cooling chamber 2 is not uniformly maintained. Furthermore, the beverages P located at the rear side of the cooling chamber 2 are frozen, but the beverages P located at the front side of the cooling chamber 2 are not supercooled. As the internal temperature of the cooling chamber 2 is not uniformly maintained, in addition, dew is formed on the door frequently open and closed, thus undesirably causing the loss of energy.

DISCLOSURE

Technical Problem

Accordingly, the present invention has been made in view of the above-mentioned problems occurring in the prior art, and it is an object of the present invention to provide a supercooling freezer that is capable of uniformly maintaining the temperature of a cooling chamber, thus uniformly supercooling objects accommodated therein, reducing the time required to transmit cool air to the objects, and capable of forming air curtains in the cooling chamber, thus improving the supercooling efficiency of the objects and the efficiency of energy.

Technical Solution

To accomplish the above-mentioned object, according to the present invention, there is provided a supercooling freezer including: a body having a cooling chamber having a plurality of shelves on which objects to be accommodated are placed and a door for opening or closing the side surface of the cooling chamber; an evaporator disposed at the upper portion of the cooling chamber to cool the air of the cooling chamber; a cooling duct for accommodating the evaporator therein; air circulation fans disposed in front of the evaporator in the cooling duct to supply the air of the cooling chamber to the evaporator; a cool air supply duct connected with the cooling duct to induce the air cooled through the evaporator in the cooling duct to the bottom of the cooling chamber; and a plurality of extension ducts projecting from the cool air supply duct in a direction in which the door is positioned to supply cool air to the objects above the objects placed on the shelves.

According to the present invention, preferably, each extension duct has a plurality of cool air discharge holes formed on the underside located above the objects and on the front surface located toward the direction in which the door is positioned so as to discharge the cool air therefrom.

According to the present invention, preferably, the front surface of each extension duct is inclined toward the bottom of the cooling chamber.

According to the present invention, preferably, the cool air supply duct includes cool air guide plates located at portions communicating with the extension ducts to guide the cool air to the extension ducts.

According to the present invention, preferably, the cool air supply duct includes cool air flow control plates adapted to induce the cool air in the opposite direction to the rotating direction of the air circulation fans, so that the cool air discharged through the rotation of the air circulation fans is uniformly distributed to the cooling chamber.

According to the present invention, preferably, the supercooling freezer further includes a defroster adapted to heat frozen water vapor in the evaporator and to remove frost from the evaporator.

According to the present invention, preferably, the defroster includes: a heater adapted to heat the evaporator; a discharge water line adapted to discharge the defrost water generated by the heater to the outside of the body; a water tank located on the underside of the body to store the defrost water discharged from the discharge water line therein; and a defrost water evaporator located inside the water tank to evaporate the defrost water stored in the water tank.

According to the present invention, preferably, the water tank has a plurality of water vapor discharge holes formed on the upper edges thereof to discharge the defrost water evaporated through the defrost water evaporator to the outside of the body.

According to the present invention, preferably, the cool air supply duct includes a temperature sensor adapted to measure a temperature of the cool air passing therethrough.

According to the present invention, preferably, the body includes a lamp adapted to irradiate light to the interior of the cooling chamber.

According to the present invention, preferably, the supercooling freezer further includes a flow rate control space portion formed between the uppermost extension duct of the cooling chamber and the cooling duct to control the pressure of the cool air to be discharged to the extension ducts.

Advantageous Effects

According to the present invention, the supercooling freezer is capable of uniformly maintaining the temperature of the cooling chamber through the extension ducts uniformly discharging the cool air to the front side at which the door is located, thus uniformly supercooling the objects accommodated therein, and further capable of directly supplying the cool air to the objects above the objects through the extension ducts, thus reducing the time required to transmit the cool air to the objects and improving the supercooling efficiency for the objects.

According to the present invention, the extension ducts are configured to have the front surfaces adapted to discharge the cool air to the bottom of the cooling chamber to form the air curtains in front of the extension ducts, thus improving the supercooling efficiency of the objects and at the same time minimizing the unnecessary consumption of the energy.

Further, the supercooling freezer according to the present invention is provided with the cool air flow control plates and the cool air guide plates adapted to uniformly distribute the cool air of the cooling chamber, thus allowing the internal temperature of the cooling chamber to be uniformly controlled.

Furthermore, the supercooling freezer according to the present invention is provided with the flow rate control space portion adapted to control the amount of cool air discharged thereto, thus controlling the pressure of the cool air supplied to the objects and the pressure of the air curtains.

DESCRIPTION OF DRAWINGS

FIG. 1 is a side sectional view showing a conventional supercooling freezer.

FIG. 2 is a schematic side sectional view showing a supercooling freezer according to the present invention.

FIG. 3 is an exploded perspective view showing an extension duct of the supercooling freezer according to the present invention.

FIG. 4 is a front view showing the supercooling freezer according to the present invention.

FIG. 5 is a side sectional view showing the supercooling freezer according to the present invention, wherein air circulation states are illustrated.

MODE FOR INVENTION

Hereinafter, an explanation on a supercooling freezer according to the present invention will be in detail given with reference to the attached drawing.

As shown in FIGS. 2 to 4, a supercooling freezer 100 according to the present invention includes a body 110.

The body 110 serves to keep objects 200 accommodated therein and further to house parts as will be explained below therein.

On the other hand, the body 110 takes a shape of a rectangular box and has a cooling chamber 117 defined by insulating materials 112 disposed along the inner edges of the body 110 and a door 111 located on one side surface thereto to open and close the cooling chamber 117.

Further, the body 110 is spaced apart from a floor by means of a plurality of support stands 115 located on the underside thereof, and in addition, the body 110 has water tank fitting portions 116 mounted on the underside thereof to mount a water tank 135 as will be discussed later thereon.

Furthermore, the body 110 has a machine chamber 114 formed on the lower portion of the rear surface thereof, and the machine chamber 114 is adapted to accommodate a compressor, a condenser, and a cooling fan for supplying cool air.

In this case, the compressor, the condenser and the cooling fan for supplying cool air are parts known to the art, and therefore, a detailed explanation for them will be avoided. The cooling chamber 117 has a plurality of shelves 119 spaced apart from each other in an up and down direction of thereof so as to seat the objects 200 thereonto.

Further, the body 110 has a lamp 113.

The lamp 113 is adapted to irradiate light to the interior of the cooling chamber 117 to brighten up the dark interior of the cooling chamber 117, and the lamp 113 is mounted on a groove formed on one side insulation material 112 to prevent the heat generated therefrom from being transmitted to the cooling chamber 117.

At this time, the lamp 113 is an LED lamp.

The supercooling freezer 100 according to the present invention includes an evaporator 120.

The evaporator 120 operates together with the compressor, the condenser and the cooling fan located in the machine chamber 114 and thus supplies cool air to the interior of the cooling chamber 117.

Referring schematically to the principle in the supply of the cool air, in this case, a refrigerant compressed in the compressor is changed into liquid when passing through the condenser, and the liquid refrigerant is expanded through an expansion valve and thus vaporized through the evaporator, so that through the vaporization, surrounding heat is derived to generate the cool air. Next, the refrigerant passing through the evaporator is compressed in the compressor, and the compressed refrigerant is changed into liquid through the condenser, so that through such refrigerant circulation, the cool air is supplied. At this time, the cooling fan is adapted to cool the condenser so as to enhance the efficiency of the condenser.

On the other hand, the evaporator 120 from which the cool air is generated is located on the upper portion of the cooling chamber 117 to cool air having a relatively high temperature, thus improving the cooling efficiency.

Further, the supercooling freezer 100 according to the present invention includes a cooling duct 125.

The cooling duct 125 accommodates the evaporator 120 therein.

On the other hand, air circulation fans 140 as will be discussed later are located on the cooling duct 125 to allow the air of the cooling chamber 117 to be circulated through the evaporator 120. At this time, the air circulation fans 140 are disposed at the front of the cooling duct 125, that is, disposed inclinedly toward the bottom of the supercooling freezer 100 at the front of the cooling chamber 117 at which the door 111 is located, so that the air existing between the door 111 and the front ends of the shelves 119 can be absorbed and supplied to the evaporator 120.

Further, the supercooling freezer 100 according to the present invention includes a defroster.

The defroster is disposed on the cooling duct 125 at which the evaporator 120 is located so as to remove frost from the evaporator 120, and the defroster includes a heater 131, a discharge water line 133, the water tank 135, and a defrost water evaporator 139.

The heater 131 is adapted to heat water vapor frozen in the evaporator 120 by means of electricity and thus to perform the defrosting for the evaporator 120, and the discharge water line 133 is adapted to discharge the defrost water generated by the heater 131 to the outside of the body 110. The water tank 135 is connected to the discharge water line 133 and stores the defrost water discharged to the outside of the body 110.

On the other hand, the water tank 135 is located on the underside of the body 110 and has a plurality of water vapor discharge holes 137 formed on the upper edges thereof to discharge the defrost water evaporated through the defrost water evaporator 139 therefrom.

Further, the water tank 135 has water tank fixing portions 136 formed on both sides of the upper portion thereof in such a manner as to be fitted to the water tank fitting portions 116 of the body 110, so that the water tank 135 can be detachably mounted onto the body 110.

The defrost water evaporator 139 is located on the lower portion of the interior of the water tank 135 to forcedly evaporate and remove the defrost water stored in the water tank 135, and the evaporated defrost water is discharged through the water vapor discharge holes 137. In this case, the defrost water evaporator 139 may become a heater.

Further, the supercooling freezer 100 according to the present invention includes a cool air supply duct 150.

The cool air supply duct 150 is adapted to induce the air cooled through the evaporator 120 located on the upper portion of the cooling chamber 117 to the bottom of the cooling chamber 117 through the rear surface of the cooling chamber 117.

Further, the cool air supply duct 150 has communication holes communicating with a plurality of extension ducts 160 as will be discussed later.

Furthermore, the cool air supply duct 150 has cool air flow control plates 155.

The cool air flow control plates 155 are adapted to induce the cool air discharged through the rotation to one side direction by means of the air circulation fans 140 to the opposite direction to the rotating direction of the air circulation fans 140.

On the other hand, the cool air flow control plates 155 are located on the surface of the cool air supply duct 150 formed in the opposite direction to the protruding directions of the extension ducts 160, and they are arranged elongatedly up and down on the cool air supply duct 150. Further, the lower portions of the cool air flow control plates 155 are bent to the opposite direction to the rotating direction of the air circulation fans 140, so that the cool air inclined toward the rotation direction of the air circulation fans 140 is dispersed in the opposite direction to the rotating direction of the air circulation fans 140, thus allowing the temperature of the cooling chamber 117 to be uniformly controlled.

Also, the cool air supply duct 150 includes cool air guide plates 151.

The cool air guide plates 151 are located at portions of the cool air supply duct 150 communicating with the extension ducts 160 to guide the cool air to the extension ducts 160.

On the other hand, the cool air guide plates 151 are bent downward to move the cool air to the bottom of the cooling chamber 117, thus first cooling the entire cooling chamber 117. Next, the cool air guide plates 151 supply the cool air raised again to the extension ducts 160 through the cool air supply duct 150.

Further, the cool air guide plates 151 are located rotatably on the cool air supply duct 150 to adjust an amount of cool air supplied to the extension ducts 160.

Further, the supercooling freezer 100 according to the present invention includes the air circulation fans 140.

The air circulation fans 140 serve to absorb the air of the cooling chamber 117 by means of the centrifugal forces generated from the rotation thereof, and the absorbed air is introduced into the cooling duct 125 and discharged to the cooling chamber 117 through the evaporator 120, the cool air supply duct 150, and the extension ducts 160, thus circulating the cool air (See FIG. 5).

That is, the air circulation fans 140 are disposed inclinedly toward the bottom of the cooling chamber 117 from the front side of the cooling duct 125 at which the door 111 is located, so that the air existing between the door 111 and the front ends of the shelves 119 can be absorbed and discharged through the evaporator 120, the cool air supply duct 150, and the extension ducts 160, thus circulating the cool air.

Further, the supercooling freezer 100 according to the present invention includes the extension ducts 160.

The extension ducts 160 serve to supply the cool air to the objects 200 above the objects 200.

On the other hand, the extension ducts 160 protrude from the cool air supply duct 150 toward the direction in which the door 111 is positioned, and in this case, the top of the front surface of each extension duct 160 is longer than the underside thereof in such a manner as to be inclined toward the bottom of the cooling chamber 117.

Further, each extension duct 160 has a plurality of cool air discharge holes 165 formed on the underside located above the objects 200 and on the front surface located toward the direction in which the door 111 is positioned so as to discharge the cool air introduced thereinto to the cooling chamber 117.

At this time, the cool air is discharged from the front surfaces of the extension ducts 160, so that air curtains are formed on the front side of the cooling chamber 117 in which the door 111 is positioned, thus minimizing the introduction of external air and the leakage of cool air when the door 111 is open and further improving the supercooling efficiencies of the objects 200.

Also, the cool air is discharged from the undersides of the extension ducts 160, so that the cool air is supplied directly to the objects 200 located under the extension ducts 160, thus improving the supercooling efficiencies of the objects 200.

Further, the shelves 119 are supportedly mounted on tops of the extension ducts 160.

Further, the supercooling freezer 100 according to the present invention includes a temperature sensor 157.

The temperature sensor 157 serves to measure and control a temperature of the cooling chamber 117.

On the other hand, the temperature sensor 157 is located on the underside of the uppermost extension duct 160 to measure and control the temperature of the cooling chamber 117, thus minimizing a temperature difference in the cooling chamber 117.

Further, a flow rate control space portion 167 is formed between the uppermost extension duct 160 and the cooling duct 125.

Before the cool air passing through the evaporator 120 is discharged to the cool air supply duct 150, it is discharged to the flow rate control space portion 167, thus controlling the pressure of the cool air to be discharged through the extension ducts 160.

For example, if the flow rate control space portion 167 is closed by means of the cool air guide plate 151 located at the portion of the cool air supply duct 150 communicating with the uppermost extension duct 160, the cool air is supplied only to the cool air supply duct 150 and the uppermost extension duct 160, so that the flow rate of the cool air is increased to allow the cool air with strong pressure to be discharged to the objects 200 and the front sides (where the air curtains are formed) of the extension ducts 160. Contrarily, if the flow rate control space portion 167 is open by means of the cool air guide plate 151 located at the portion of the cool air supply duct 150 communicating with the uppermost extension duct 160, a portion of the cool air is discharged to the flow rate control space portion 167, so that the flow rate of the cool air is decreased to allow the cool air with weak pressure to be discharged to the objects 200 and the front sides (where the air curtains are formed) of the extension ducts 160.

Now, an explanation on the operating effects of the respective parts of the supercooling freezer 100 as mentioned above will be given.

According to the present invention, the door 111 is coupled to one side surface of the body 110 of the supercooling freezer 100, and the machine chamber 114 is formed on the lower portion of the other side surface of the body 110. Further, the body 110 has the plurality of support stands 115 mounted on the underside thereof so that the body 110 is spaced apart from a floor. In addition, the body 110 has the water tank fitting portions 116 mounted on the underside thereof. Next, the body 110 has the cooling chamber 117 defined by the insulating materials 112 disposed along the inner edges thereof, and the insulating materials 112 serve to prevent cool air from being discharged to the outside. Further, the lamp 113 is mounted on the groove formed on one side insulation material 112 of the body 110.

At this time, the cooling chamber 117 has the plurality of shelves 119 spaced apart from each other in up and down directions thereof so as to seat the objects 200 thereonto.

The cooling duct 125 is located on the upper side of the cooling chamber 117, and the air circulation fans 140 are located on the front side of the cooling duct 125 in which the door 111 is located. Further, the evaporator 120 is located inside the cooling duct 125.

The heater 131 is located on the portion of the cooling duct 125 at which the evaporator 120 is positioned so as to perform defrosting, and the defrost water generated from the heater 131 is discharged to the water tank 135 through the discharge water line 133. The water tank 135, which stores and evaporates the defrost water, is located in such a manner where the water tank fixing portions 136 are fitted to the water tank fitting portions 116 formed on the underside of the body 110.

The extension ducts 160 are located on the cool air supply duct 150 connected to the cooling duct 125 so as to discharge the cool air to the cooling chamber 117, and the temperature sensor 157 is located on the underside of the uppermost extension duct 160 to measure the temperature of the cooling chamber 117.

Further, the cool air flow control plates 155 are located inside the cool air supply duct 150 to induce the cool air rotating by means of the air circulation fans 140 in the opposite direction to the rotating direction of the air circulation fans 140, and moreover, the cool air supply duct 150 has the cool air guide plates 151 adapted to control the amount of air to be discharged to the extension ducts 160.

If power is applied to the supercooling freezer 100 according to the present invention, the air of the cooling chamber 117 is passed through the cooling duct 125 and then introduced into the evaporator 120 by means of the air circulation fans 140. The introduced air is cooled by means of the evaporator 120 and then discharged to the cool air supply duct 150. The cool air discharged to the cool air supply duct 150 is dispersed in the opposite direction to the rotating direction of the air circulation fans 140 by means of the cool air flow control plates 155 and then introduced into the extension ducts 160.

At this time, the amount of air discharged to the extension ducts 160 is controlled by means of the cool air guide plates 151.

In the process where the cool air introduced into the extension ducts 160 is discharged to the cooling chamber 117, the objects 200 located on the shelves 119 are cooled by the cool air discharged from the undersides of the extension ducts 160, and at the same time, the cool air is discharged from the front sides of the extension ducts 160 to form the air curtains.

Next, the air discharged through the extension ducts 160 is absorbed again by means of the air circulation fans 140 and moved to the cooling duct 125. As a result, the air is circulated.

So as to control the pressure of the air curtains or to adjust the pressure of the cool air supplied to the objects 200, moreover, a degree of opening of the cool air guide plate 151 for opening and closing the flow rate control space portion 167 is controlled.

As described above, the supercooling freezer according to the present invention is capable of stably circulating the cool air by means of the cool air discharge holes formed on the front and underside surfaces of the extension ducts, thus uniformly maintaining the temperature of the cooling chamber, reducing the time required to transmit the cool air to the objects placed on the shelves, and improving the supercooling efficiencies of the objects.

Further, the supercooling freezer according to the present invention is capable of forming the air curtains in front of the extension ducts, thus preventing the cool air from coming into contact with the door to reduce the amount of dew formed, and in addition, the supercooling freezer according to the present invention is capable of minimizing the leakage of the cool air to the outside when the door is open and closed, thus enhancing the efficiency of energy.

In the conventional practice where the cool air is discharged from the rear surfaces of the shelves, the cool air is not discharged gently due to the objects placed on the shelves, so that there is a difference between the supercooling of the objects placed on the rear surfaces of the shelves and the supercooling of the objects placed on the front surfaces of the shelves. According to the present invention, however, the cool air is supplied to the objects above the objects, thus preventing a difference in the supercooling of the objects from being generated according to the positions of the objects.

Additionally, the supercooling freezer according to the present invention is capable of forming the flow rate control space portion to control the amount of cool air discharged thereto, thus controlling the pressure of the cool air supplied to the objects and the pressure of the air curtains.

While the present invention has been described with reference to the particular illustrative embodiments, it is not to be restricted by the embodiment but only by the appended claims. It is to be appreciated that those skilled in the art can change or modify the embodiments without departing from the scope and spirit of the present invention.

INDUSTRIAL APPLICABILITY

According to the present invention, the supercooling freezer is useful in various industrial fields.

The invention claimed is:

1. A supercooling freezer comprising:

a body having a cooling chamber having a plurality of shelves on which objects to be accommodated are placed and a door for opening or closing the side surface of the cooling chamber;

an evaporator disposed at the upper portion of the cooling chamber to cool the air of the cooling chamber;

a cooling duct for accommodating the evaporator therein;

air circulation fans disposed in front of the evaporator in the cooling duct to supply the air of the cooling chamber to the evaporator;

a cool air supply duct connected with the cooling duct to induce the air cooled through the evaporator in the cooling duct to the bottom of the cooling chamber;

a plurality of extension ducts protruding from the cool air supply duct in a direction in which the door is positioned and disposed above the objects which are placed on the shelves, the extension ducts discharging cool air downward direction to the objects such that the cool air is supplied directly to the objects; and a flow rate control space portion formed between an uppermost extension duct of the extension ducts and the cooling duct, the flow rate control space portion configured to allow a portion of the cool air to be discharged to the flow rate control space portion such that the pressure of the cool air discharged to the extension ducts is decreased.

2. The supercooling freezer according to claim 1, wherein each extension duct has a plurality of cool air discharge holes formed on the underside located above the objects and on the front surface located toward the direction in which the door is positioned so as to discharge the cool air therefrom.

3. The supercooling freezer according to claim 2, wherein the front surface of each extension duct is inclined toward the bottom of the cooling chamber.

4. The supercooling freezer according to claim 1, wherein the cool air supply duct comprises cool air guide plates located at portions communicating with the extension ducts to guide the cool air to the extension ducts.

5. The supercooling freezer according to claim 1, wherein the cool air supply duct comprises cool air flow control plates adapted to induce the cool air in the opposite direction to the rotating direction of the air circulation fans, so that the cool air discharged through the rotation of the air circulation fans is uniformly distributed to the cooling chamber.

6. The supercooling freezer according to claim 1, further comprising a defroster adapted to heat frozen water vapor in the evaporator and to remove frost from the evaporator.

7. The supercooling freezer according to claim 6, wherein the defroster comprises:

a heater adapted to heat the evaporator;

a discharge water line adapted to discharge the defrost water generated by the heater to the outside of the body;

a water tank located on the underside of the body to store the defrost water discharged from the discharge water line therein; and a defrost water evaporator located inside the water tank to evaporate the defrost water stored in the water tank.

8. The supercooling freezer according to claim 7, wherein the water tank has a plurality of water vapor discharge holes formed on the upper edges thereof to discharge the defrost water evaporated through the defrost water evaporator to the outside of the body.

9. The supercooling freezer according to claim 1, wherein the cool air supply duct comprises a temperature sensor adapted to measure a temperature of the cool air passing therethrough.

10. The supercooling freezer according to claim 1, wherein the body comprises a lamp adapted to irradiate light to the interior of the cooling chamber.

* * * * *